United States Patent [19]

Pabst

[11] Patent Number: 4,785,737

[45] Date of Patent: Nov. 22, 1988

[54] BUFFERED LEAD-IN GUIDE FOR CABLEWAY VEHICLES

[75] Inventor: Otto Pabst, Meransen, Italy

[73] Assignee: Leitner, S.p.A., Bolzano, Italy

[21] Appl. No.: 917,174

[22] Filed: Oct. 9, 1986

[30] Foreign Application Priority Data

Oct. 9, 1985 [IT] Italy ..... 2336/85[U]

[51] Int. Cl.[4] ..... B61B 7/00

[52] U.S. Cl. ..... 104/173.1; 104/211; 104/307

[58] Field of Search ..... 104/173.1, 173.2, 202, 104/211, 213, 89, 307; 267/153, 177, 292, 293

[56] References Cited

U.S. PATENT DOCUMENTS

| | | | |
|---|---|---|---|
| 3,610,164 | 10/1971 | Feuz | 104/211 X |
| 4,327,646 | 5/1982 | Nakata et al. | 104/89 |
| 4,512,259 | 4/1985 | Kermadec | 104/211 X |
| 4,641,732 | 2/1987 | Andry | 267/292 X |
| 4,653,406 | 3/1987 | Levi | 104/211 |
| 4,653,736 | 3/1987 | Pontoppidan | 267/177 X |

FOREIGN PATENT DOCUMENTS

| | | | |
|---|---|---|---|
| 248671 | 5/1947 | Switzerland | 104/89 |
| 2065049 | 6/1981 | United Kingdom | 104/89 |

*Primary Examiner*—Robert B. Reeves
*Assistant Examiner*—Russell D. Stormer
*Attorney, Agent, or Firm*—Oblon, Fisher, Spivak, McClelland & Maier

[57] ABSTRACT

Buffered lead-in guide for cableway vehicles constrained to a haulage cable by a hooking device of the clamp type, and provided, in an upper hanging-up portion thereof, with at least one pivot provided with balancing and guide rotary elements acting inside the lead-in guide. The lead-in guide is constrained to outer supports and is provided with an enlarged mouth portion which gets narrower up to an inner dimension close to that of the rotary elements. The enlarged portion is arranged in a substantially cantilevered position and in correspondence of at least a first support of the outer supports. Elastic elements positioned between the lead-in guide and the outer support are provided.

4 Claims, 2 Drawing Sheets

BUFFERED LEAD-IN GUIDE FOR CABLEWAY VEHICLES

FIELD OF THE INVENTION

The present invention relates to a buffered lead-in guide for cableway vehicles.

BACKGROUND OF THE INVENTION

It is known to provide guide elements which receive the cableway vehicle, above all in the vicinity of the stations, and which cause it to place itself in a balanced position, so to facilitate the operations of clamp unlocking, and of passengers boarding and getting out.

Guide elements of the above mentioned type are obtained from sections or from welded elements having an essentially "C"-shaped cross section, so to receive a wheel or other rotary means provided on the vehicle supporting device, so to guide and balance it in the vicinity of the stations or of other particular guided areas.

In general, a so structured guide element is provided with a particularly enlarged mouth portion, rearward constrained to a rigid beam, which receives the rotary means, even if it is rocking, and, by getting narrower until it reaches the dimension of a rather precise guide, causes the vehicle to be stabilized and balanced.

The correct and stable position of the vehicle secures, or at least favours, the operation of the mechanism of clamping to the haulage cable, and it facilitates the boarding and the getting out of passengers.

The arrangement of such a guide solid with outer support means causes strong stresses between the guide and the related wheels of the support devices of the vehicles which arrive after each other, by being hauled by the haulage cable. In fact, although the end portion of the guide element is enlarged and is arranged in a cantilevered position, the bump occurring between the individual wheels and the guide generates in the long term deformations of the guide, and dangerous oscillations, which weaken the clamp device, with risk of breakage.

OBJECTS OF THE INVENTION

A principal object of the present invention is to at least partly eliminate the above mentioned oscillations, reducing as far as possible the stresses and the reaction forces deriving therefrom.

A further object is to obtain a quicker and better stabilization of the incoming vehicles.

SUMMARY OF THE INVENTION

These and other purposes, according to the invention, are achieved by providing a buffered lead-in guide for cableway vehicles constrained to a haulage cable by means of a hooking device of the clamp type, and provided, in an upper hanging-up portion thereof, with at least one pivot provided with balancing and guide rotary elements acting inside the lead-in guide. The lead-in guide is constrained to outer supports and is provided with an enlarged mouth portion which gets narrower up to an inner dimension close too that of the rotary elements. The enlarged portion is arranged in a substantially cantilevered position and in correspondence of at least a first support of the outer supports. Elastic elements positioned between the lead-in guide and the outer support are provided.

BRIEF DESCRIPTION OF THE DRAWINGS

Characteristics and advantages of a guide for cableway vehicles according to the present invention shall be better clarified from the following exemplifying and nonlimitative description referred to the related schematic drawings wherein.

DETAILED DESCRIPTION OF THE PRESENTLY PREFERRED EMBODIMENT

Figure 1:
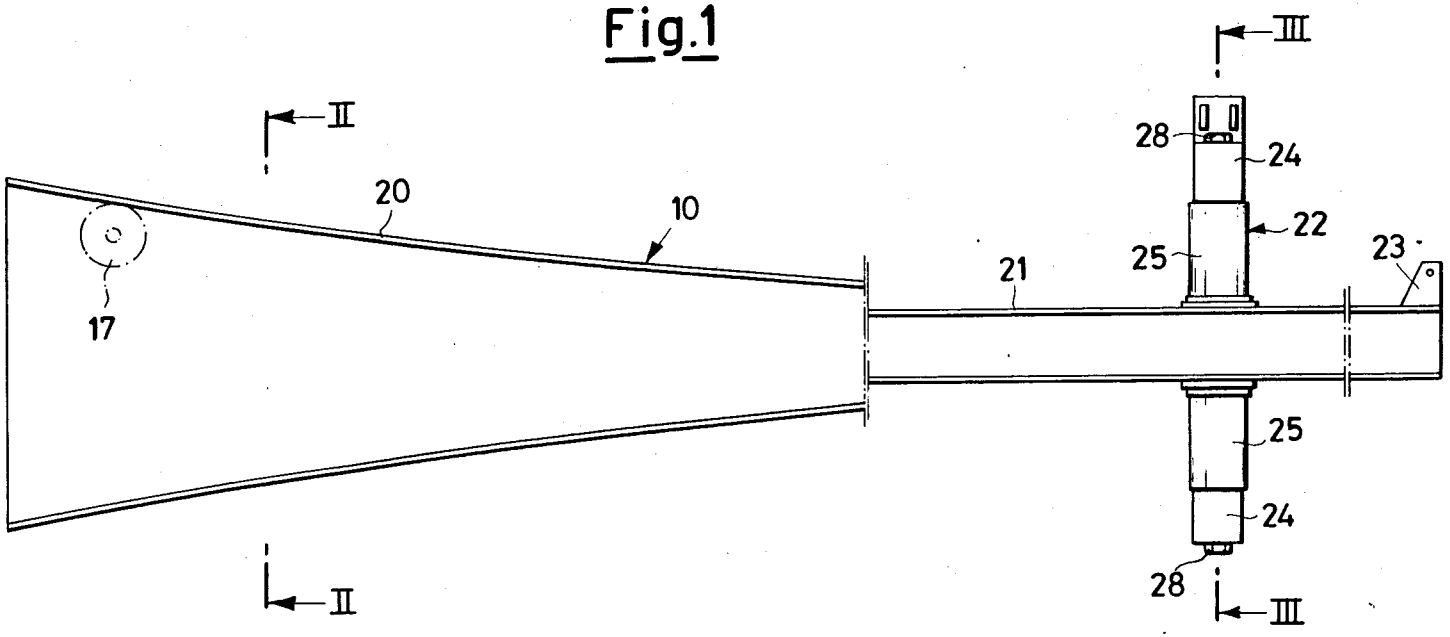
FIG. 1 is a partial and schematic elevation view of a lead-in guide according to the present invention.
Figure 2:
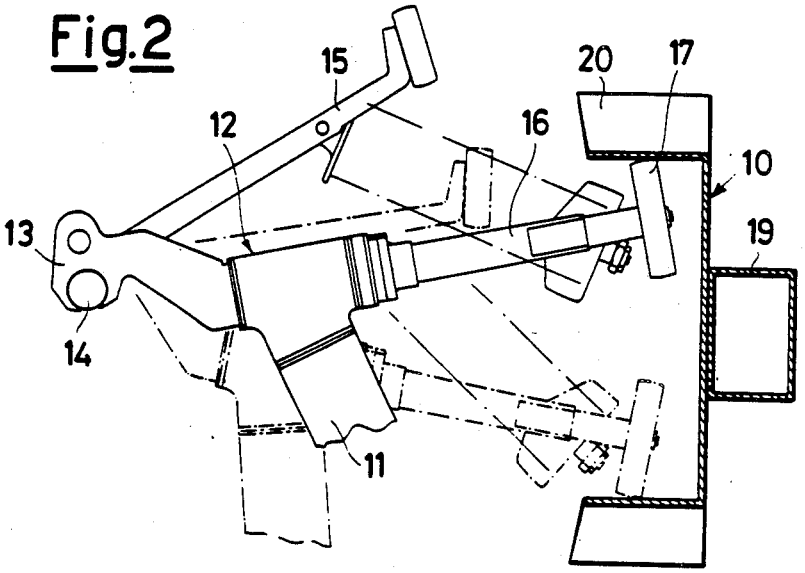
FIG. 2 is a sectional view on the line II—II of FIG. 1.
Figure 3:
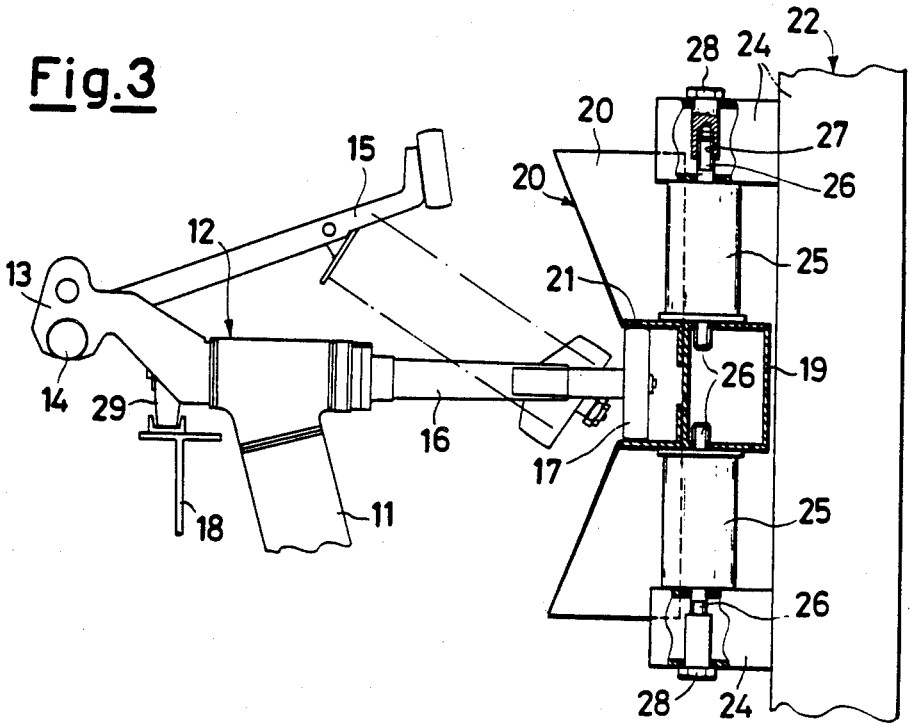
FIG. 3 is a sectional view on the line III—III of FIG. 1.

Referring to the drawings, a buffered lead-in guide, according to the invention, and generally indicated with 10, is installed, e.g., in correspondence of an entrance of a station, so as to receive and guide cableway vehicles (not shown). The cableway vehicles are hung by a support element 11 extending from a hooking device 12 comprising a blocking clamp 13 for a cable 14, a device 15 for opening the clamp 13, at least one sliding wheel 29, and at least one arm 16 bearing at its end a rotary element 17, e.g., a wheel.

A first wheel 17 enters the guide 10, while a second sliding wheel 29 comes above a guide and support track 18.

The guide 10, having a "C"-shaped cross-section, and rearward constrained to a rigid beam 19, comprises an enlarged mouth section 20, which becomes gradually narrower, radiused towards a guide portion 21, the inner dimension of which is slightly greater than, and close to, the diameter of the wheel 17.

The enlarged mouth portion 20 is arranged in a cantilevered position. It extends from the guide portion 21 supported together with the rigid beam 19 inside at least a first outer support 22 and a second outer support 23.

The first outer support 22 is composed by at least three beams 24 so welded and linked to one another, as to form a housing for the guide portion 21 with the interposition of elastic elements 25 on both the sides thereof.

More particularly, the elastic elements 25 are constrained by screw bolts 26 both to the rigid beam 19 and to the beams 24 of the outer support 22, where they position themselves, adjustable in position, inside related threaded seats 27 provided on studs 28 which can be rotatably operated from the outside.

The second outer support 23 is a simple section to which the rigid beam 19 is constrained (e.g., is hung), and in a particular form of practical embodiment it can be provided with a hinge for the rigid beam 19, so as to increase the positive effect of the elastic elements 25, allowing an articulation, even if of minimum extent, of the lead-in guide 10.

Of course, the elastic elements 25 can be accomplished either by steel springs or by pads of elastomeric material, so to be able to guarantee a good absorption of the impact as the wheel 17 enters the enlarged mouth section 20 of the guide 10, without however undergoing deformations, or, which is more important, without promoting the breakage or the damaging of the outer supports.

Furthermore, the elastic elements 25 can advantageously have also buffering properties, so as to limit, even if not to eliminate, the return forces of the guide 10 after the guide 10 has received the bumps of the wheels of the cableway vehicle.

The presence of the screw bolts 26 at the ends of the elastic elements 25 or inside containment elements thereof allows them to be easily and quickly positioned and dismantled for replacement, whilst the provision of the studs 28 actuatable from the outside allows the elastic elements 25 to be calibrated, so to confer the desired response or absorption value.

I claim:

1. A buffered lead-in guide for rotary wheels of cableway vehicles, said buffered lead-in guide comprising:

a cantilevered enlarged mouth section that is C-shaped in cross-section, that gradually decreases in height from an open first end to a second end, and that has a planar rear surface;

(b) a guide portion that is C-shaped in cross-section, that is of at least substantially constant height, that has a first end that merges with the second end of said enlarged mouth section and a second end, that has a rear planar surface that merges with the rear planar surface of said enlarged mouth section, and that opens laterally in the same direction as said enlarged mouth section;

(c) a rigid beam that has a planar front surface that makes planar supporting contact with the planar rear surfaces of said enlarged mouth section and said guide portion;

(d) an outer support that is C-shaped in cross-section, that surrounds said guide portion and said rigid beam, and that opens laterally in the same direction as said enlarged mouth section;

(e) a first at least approximately vertically disposed elastic element disposed between the top of said rigid beam and said outer support; and (f) a second at least approximately vertically disposed elastic element disposed between the bottom of said rigid beam and said outer support, whereby vertical oscillation of said rigid beam due to impacts of the rotary wheels of cableway vehicles on said enlarged mouth section and said guide portion are at least partially absorbed by said first and second elastic elements.

2. A buffered lead-in guide as recited in claim 1 wherein said first and second elastic elements are compression springs.

3. A buffered lead-in guide as recited in claim 2 and further comprising means for calibrating said compression springs.

4. A buffered lead-in guide as recited in claim 1 wherein said first and second elastic elements are pads made from elastomeric material.

* * * * *